US010555650B2

(12) United States Patent
Genn et al.

(10) Patent No.: US 10,555,650 B2
(45) Date of Patent: Feb. 11, 2020

(54) CLEANER APPLIANCE

(71) Applicant: Dyson Technology Limited, Wiltshire (GB)

(72) Inventors: Stuart Lloyd Genn, Swindon (GB); James White, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 283 days.

(21) Appl. No.: 14/662,745

(22) Filed: Mar. 19, 2015

(65) Prior Publication Data

US 2015/0265116 A1 Sep. 24, 2015

(30) Foreign Application Priority Data

Mar. 19, 2014 (GB) ..... 1404919.1

(51) Int. Cl.
*A47L 9/04* (2006.01)
*A47L 9/02* (2006.01)

(52) U.S. Cl.
CPC ..... *A47L 9/0411* (2013.01); *A47L 9/02* (2013.01); *A47L 9/0477* (2013.01)

(58) Field of Classification Search
None
See application file for complete search history.

(56) References Cited

U.S. PATENT DOCUMENTS 1,613,396 A 1/1927 Keller
1,770,643 A 7/1930 Giambertoni
1,914,834 A 6/1933 Otto
1,953,340 A 4/1934 Doemling
3,172,138 A 3/1965 Price
4,268,769 A 5/1981 Dorner et al.
4,384,386 A 5/1983 Dorner et al.
4,538,322 A 9/1985 Ahlf et al.
4,660,247 A 4/1987 Frohbieter et al.
4,777,691 A 10/1988 Richmond et al.
6,134,745 A 10/2000 Wörwag
6,320,292 B1 11/2001 Tateishi et al.
(Continued)

FOREIGN PATENT DOCUMENTS

DE 529616 7/1931
DE 1 728 324 10/1971
(Continued)

OTHER PUBLICATIONS

International Search Report and Written Opinion mailed May 12, 2015, directed to International Application No. PCT/GB2015/050665; 11 pages.

(Continued)

*Primary Examiner* — Brian D Keller
(74) *Attorney, Agent, or Firm* — Morrison & Foerster LLP

(57) ABSTRACT

A cleaning appliance having a cleaner head rotatably attached to a duct. The cleaner head includes a main body having an agitator chamber, an agitator rotatably mounted within the agitator chamber, and a drive assembly coupled to the agitator such that torque generated by the drive assembly is transmitted to the agitator. The drive assembly is located within the agitator such that the centre of gravity of the cleaner head is located on or near a vertical plane containing the rotational axis about which the cleaner head rotates relative to the duct.

11 Claims, 5 Drawing Sheets

(56) References Cited

U.S. PATENT DOCUMENTS

| | | | | |
|---|---|---|---|---|
| 6,323,570 | B1 | 11/2001 | Nishimura | |
| 8,572,804 | B2 | 11/2013 | Tran et al. | |
| 2002/0032948 | A1 | 3/2002 | Ahn et al. | |
| 2002/0060140 | A1* | 5/2002 | Nakamura | B65G 23/08 198/788 |
| 2002/0079761 | A1 | 6/2002 | Nishimura et al. | |
| 2002/0184732 | A1 | 12/2002 | Kim et al. | |
| 2002/0194697 | A1 | 12/2002 | Park | |
| 2003/0037408 | A1 | 2/2003 | Park | |
| 2003/0159240 | A1 | 8/2003 | Mertes et al. | |
| 2003/0188397 | A1 | 10/2003 | Syverson et al. | |
| 2004/0000023 | A1 | 1/2004 | Hitzelberger et al. | |
| 2004/0010884 | A1 | 1/2004 | Hitzelberger | |
| 2004/0025287 | A1 | 2/2004 | McCormick et al. | |
| 2005/0160555 | A1 | 7/2005 | Mayes | |
| 2005/0160556 | A1 | 7/2005 | Hitzelberger et al. | |
| 2005/0172447 | A1 | 8/2005 | Roney et al. | |
| 2006/0064828 | A1* | 3/2006 | Stein | A47L 9/0455 15/41.1 |
| 2009/0089958 | A1 | 4/2009 | Dant et al. | |
| 2010/0037422 | A1 | 2/2010 | Behrenswerth et al. | |
| 2010/0107357 | A1 | 5/2010 | Odachi et al. | |
| 2011/0303239 | A1 | 12/2011 | Harrison et al. | |
| 2015/0265117 | A1 | 9/2015 | Genn et al. | |

FOREIGN PATENT DOCUMENTS

| | | |
|---|---|---|
| DE | 197 06 239 | 4/1998 |
| DE | 198 05 899 | 7/1999 |
| DE | 198 05 900 | 7/1999 |
| DE | 198 05 901 | 8/1999 |
| DE | 20 2011 104 043 | 11/2011 |
| GB | 2 224 042 | 4/1990 |
| GB | 2 322 068 | 8/1998 |
| GB | 2 376 177 | 12/2002 |
| GB | 2 376 876 | 12/2002 |
| GB | 2499213 | 8/2013 |
| JP | 54-118659 | 9/1979 |
| JP | 63-102740 | 5/1988 |
| JP | 63-102741 | 5/1988 |
| JP | 63-125227 | 5/1988 |
| JP | 63-132624 | 6/1988 |
| JP | 63-154143 | 6/1988 |
| JP | 63-154144 | 6/1988 |
| JP | 63-158030 | 7/1988 |
| JP | 63-158031 | 7/1988 |
| JP | 63-229017 | 9/1988 |
| JP | 63-296719 | 12/1988 |
| JP | 64-25824 | 1/1989 |
| JP | 1-166730 | 6/1989 |
| JP | 1-99347 | 7/1989 |
| JP | 1-265930 | 10/1989 |
| JP | 2-95675 | 4/1990 |
| JP | 2-209113 | 8/1990 |
| JP | 7-313411 | 12/1995 |
| JP | 7-327880 | 12/1995 |
| JP | 7-327882 | 12/1995 |
| JP | 7-327884 | 12/1995 |
| JP | 8-38400 | 2/1996 |
| JP | 11-42184 | 2/1999 |
| JP | 2000-217754 | 8/2000 |
| JP | 2000-245661 | 9/2000 |
| JP | 2000-245662 | 9/2000 |
| JP | 2000-245663 | 9/2000 |
| JP | 2000-254052 | 9/2000 |
| JP | 2000-254053 | 9/2000 |
| JP | 2000-296082 | 10/2000 |
| JP | 2000-308607 | 11/2000 |
| JP | 2000-308608 | 11/2000 |
| JP | 2000-316762 | 11/2000 |
| JP | 2000-316763 | 11/2000 |
| JP | 2000-316764 | 11/2000 |
| JP | 2000-333891 | 12/2000 |
| JP | 2000-354569 | 12/2000 |
| JP | 2001-371 | 1/2001 |
| JP | 2001-8405 | 1/2001 |
| JP | 2001-157657 | 6/2001 |
| JP | 2001-204657 | 7/2001 |
| JP | 2001-231727 | 8/2001 |
| JP | 2001-238831 | 9/2001 |
| JP | 2001-245831 | 9/2001 |
| JP | 2001-346729 | 12/2001 |
| JP | 2001-346730 | 12/2001 |
| JP | 2002-238815 | 8/2002 |
| JP | 2002-272654 | 9/2002 |
| JP | 2002-315700 | 10/2002 |
| JP | 2004-57446 | 2/2004 |
| JP | 2005-312589 | 11/2005 |
| JP | 2009-247723 | 10/2009 |
| WO | WO-2008/128751 | 10/2008 |

OTHER PUBLICATIONS

Search Report dated Sep. 18, 2014, directed to GB Application No. 1404919.1; 1 pg.

Genn et al., U.S. Office Action dated Mar. 17, 2017 directed to U.S. Appl. No. 14/662,923; 14 pages.

Genn et al., U.S. Office Action dated Nov. 17, 2017, directed to U.S. Appl. No. 14/662,923; 13 pages.

Genn et al., U.S. Office Action dated Jul. 18, 2018, directed to U.S. Appl. No. 14/662,923; 15 pages.

* cited by examiner

CLEANER APPLIANCE

REFERENCE TO RELATED APPLICATION

This application claims priority to United Kingdom Application No. 1404919.1, filed Mar. 19, 2014, the entire contents of which are incorporated herein by reference.

FIELD OF THE INVENTION

The present invention relates to a cleaning appliance.

BACKGROUND OF THE INVENTION

A cleaning appliance, such as a vacuum cleaner, may include a cleaner head that is rotatably attached to a duct, and the cleaner head may include a rotary agitator that is driven by a drive assembly. The centre of gravity of the cleaner head is typically offset relative to the axis of rotation about which the cleaner head rotates. Consequently, when the cleaner head is lifted off the floor (e.g. in order to manoeuvre the cleaner head over or around an obstacle), the cleaner head tends to rotate to one side. This then makes handling of the cleaner head more difficult.

SUMMARY OF THE INVENTION

The present invention provides a cleaning appliance comprising a cleaner head rotatably attached to a duct, the cleaner head comprising a main body having an agitator chamber, an axle that extends into the chamber, a drive assembly mounted on the axle, and an agitator mounted within the agitator chamber so as to surround the drive assembly, wherein the drive assembly is coupled to the agitator such that torque generated by the drive assembly is transmitted to the agitator, the cleaner head rotates relative to the duct about a rotational axis, and the drive assembly is mounted along the axle such that the centre of gravity of the cleaner head is located on a vertical plane containing the rotational axis.

By locating the drive assembly within the agitator, a relatively compact cleaner head may be realised. Furthermore, the drive assembly is able to transfer torque to the agitator without the need for a complex transmission arrangement. This then enables the drive assembly to be located at a position which results in a centre of gravity for the cleaner head that is located in a vertical plane containing the rotational axis about which the cleaner head rotates. Consequently, when the cleaner head is lifted off the floor, the cleaner head does not rotate relative to the duct. This then makes handling of the cleaner head easier.

Reference is made to a vertical plane since it is not essential that the centre of gravity of the cleaner head lies directly on the rotational axis. Rotation of the cleaner head relative to the duct will also be prevented by having a centre of gravity that is located directly above or below the rotational axis.

The term 'containing' should be understood to mean that the rotational axis is contained wholly within the vertical plane (i.e. the rotational axis is parallel to the vertical plane) and not simply that the rotational axis passes through the vertical plane.

The drive assembly may comprise a motor mount and an electric motor. The motor mount may then be attached at one end to the axle and at an opposite end to the electric motor. Moreover, the motor mount may extend through the vertical plane such that the axle and the electric motor are located on opposite sides of the vertical plane. In conventional cleaner heads having an electric motor located inside the agitator, the electric motor is typically located at one end of the agitator chamber. However, the electric motor is a relatively heavy component and thus the centre of gravity of the cleaner head is generally pulled towards that end of the agitator chamber. By employing a motor mount that extends through the vertical plane, the electric motor may be positioned such that the centre of gravity of the cleaner head is located in the vertical plane.

The cleaner head may comprise a bearing assembly mounted on the axle, and the agitator may be mounted on the bearing assembly. This then enables a relatively compact arrangement. In particular, the inner diameter of the agitator may be sized such that the clearance between the agitator and the drive assembly is relatively tight. In contrast, if the bearing assembly were mounted on the drive assembly, an agitator having a larger inner diameter would be required.

The main body of the cleaner head may comprise an opening through which the agitator is removable. The cleaner head may then comprise an end cap that attachable to the main body to close the opening. Moreover, the agitator may be mounted at a first end on the bearing assembly and at a second end on a bearing or bushing seated within the end cap at a second end. A removable agitator has the advantage that the agitator may be more easily cleaned, maintained or repaired.

The agitator may rotate about an axis that is orthogonal to the rotational axis of the cleaner head.

In a second aspect, the present invention provides a cleaning appliance comprising a cleaner head rotatably attached to a duct, the cleaner head comprising a main body having an agitator chamber, an axle that extends into the chamber, a drive assembly mounted on the axle, and an agitator mounted within the agitator chamber so as to surround the drive assembly, wherein the drive assembly is coupled to the agitator such that torque generated by the drive assembly is transmitted to the agitator, the cleaner head rotates relative to the duct about a rotational axis, the drive assembly comprises a motor mount and an electric motor, the motor mount is attached at one end to the axle and at an opposite end to the electric motor, and the motor mount extends through a vertical plane containing the rotational axis.

By locating the drive assembly within the agitator, a relatively compact cleaner head may be realised. Furthermore, the drive assembly is able to transfer torque to the agitator without the need for a complex transmission arrangement. In conventional cleaner heads having an electric motor located inside the agitator, the electric motor is typically located at one end of the agitator chamber. However, the electric motor is a relatively heavy component and thus the centre of gravity of the cleaner head is generally pulled towards that end of the agitator chamber. By employing a motor mount that extends through the vertical plane containing the rotational axis about which the cleaner head rotates, the electric motor may be positioned such that the centre of gravity of the cleaner head is located on or near the vertical plane. Consequently, handling of the cleaner head is made easier.

The cleaner head may comprise a bearing assembly mounted on the axle, and the agitator may be mounted on the bearing assembly. This then enables a relatively compact arrangement. In particular, the inner diameter of the agitator may be sized such that the clearance between the agitator and the drive assembly is relatively tight. In contrast, if the bearing assembly were mounted on the drive assembly, an agitator having a larger inner diameter would be required.

The main body of the cleaner head may comprise an opening through which the agitator is removable. The cleaner head may then comprise an end cap that attachable to the main body to close the opening. Moreover, the agitator may be mounted at a first end on the bearing assembly and at a second end on a bearing or bushing seated within the end cap at a second end. A removable agitator has the advantage that the agitator may be more easily cleaned, maintained or repaired.

The agitator may rotate about an axis that is orthogonal to the rotational axis of the cleaner head.

In a third aspect, the present invention provides a cleaning appliance comprising a cleaner head rotatably attached to a duct, the cleaner head comprising a main body having an agitator chamber, an agitator rotatably mounted within the agitator chamber, and a drive assembly coupled to the agitator such that torque generated by the drive assembly is transmitted to the agitator, wherein the cleaner head rotates relative to the duct about a rotational axis, and the drive assembly is located within the agitator such that the centre of gravity of the cleaner head is located on a vertical plane containing the rotational axis.

By locating the drive assembly within the agitator, a relatively compact cleaner head may be realised. Furthermore, the drive assembly is able to transfer torque to the agitator without the need for a complex transmission arrangement. This then enables the drive assembly to be located at a position which results in a centre of gravity for the cleaner head that is located in a vertical plane containing the rotational axis about which the cleaner head rotates. Consequently, when the cleaner head is lifted off the floor, the cleaner head does not rotate relative to the duct. This then makes handling of the cleaner head easier.

The agitator may rotate about a further rotational axis that is orthogonal to the rotational axis.

The main body may comprise an opening through which the agitator is removable, and the cleaner head may comprise an end cap attachable to the main body to close the opening. The agitator may then be mounted at one end on a bearing or bushing seated within the end cap. A removable agitator has the advantage that the agitator may be more easily cleaned, maintained or repaired.

The drive assembly may comprise a motor mount and an electric motor. The motor mount may then be attached at one end to the main body and at an opposite end to the electric motor. Moreover, the motor mount may extend through the vertical plane. In conventional cleaner heads having an electric motor located inside the agitator, the electric motor is typically located at one end of the agitator chamber. However, the electric motor is a relatively heavy component and thus the centre of gravity of the cleaner head is generally pulled towards that end of the agitator chamber. By employing a motor mount that extends through the vertical plane, the electric motor may be positioned such that the centre of gravity of the cleaner head is located in the vertical plane.

The drive assembly may comprise a circuit assembly for controlling the electric motor, and the circuit assembly may be housed within the motor mount.

BRIEF DESCRIPTION OF THE DRAWINGS

In order that the present invention may be more readily understood, an embodiment of the invention will now be described, by way of example, with reference to the accompanying drawings in which.

DETAILED DESCRIPTION OF THE INVENTION

Figure 1:
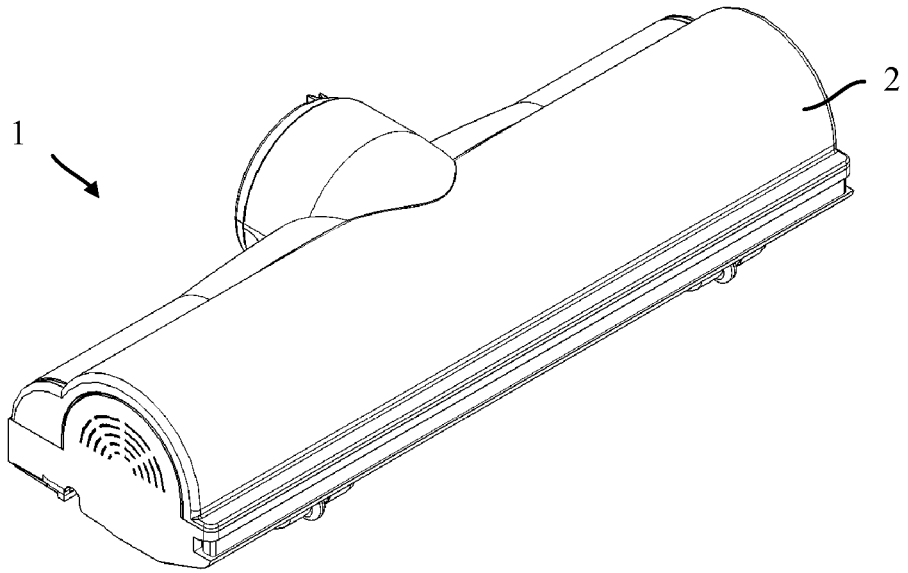
FIG. 1 illustrates a cleaner head in accordance with the present invention.
Figure 2:
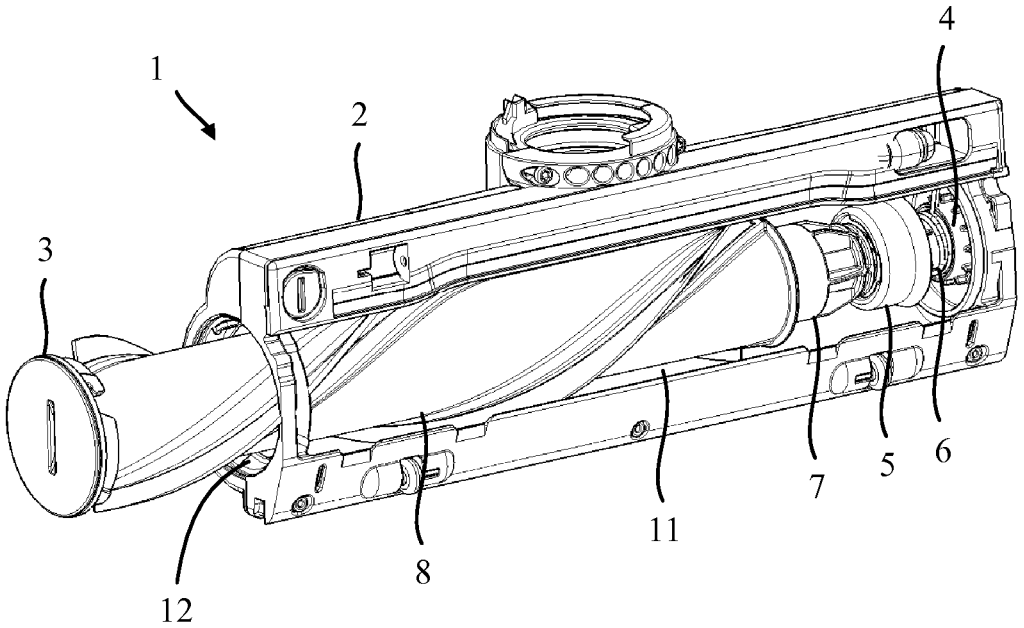
FIG. 2 illustrates the underside of the cleaner head with the agitator partially removed.
Figure 3:
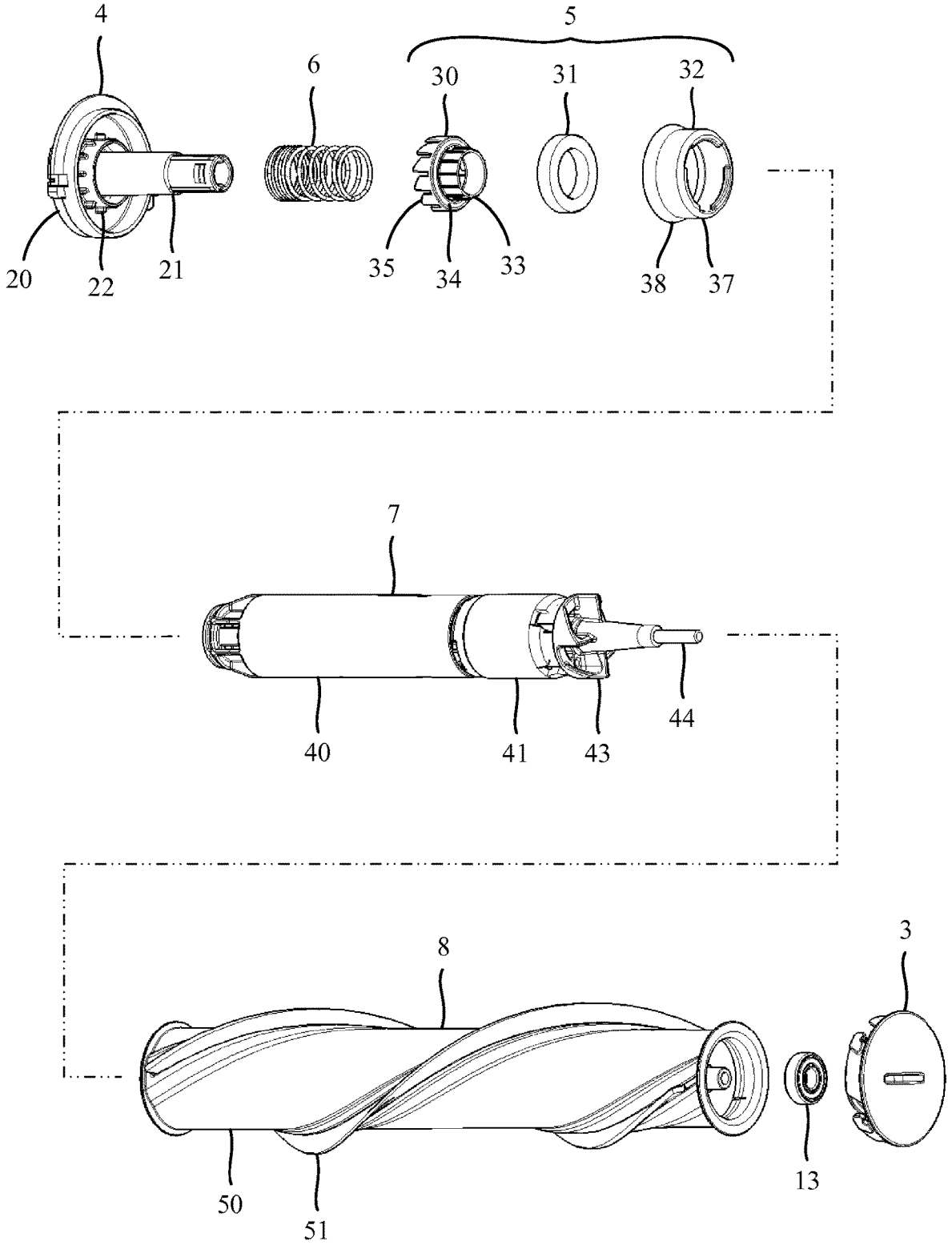
FIG. 3 is an exploded view of the end caps, the bearing assembly, the drive assembly and the agitator of the cleaner head.
Figure 4:
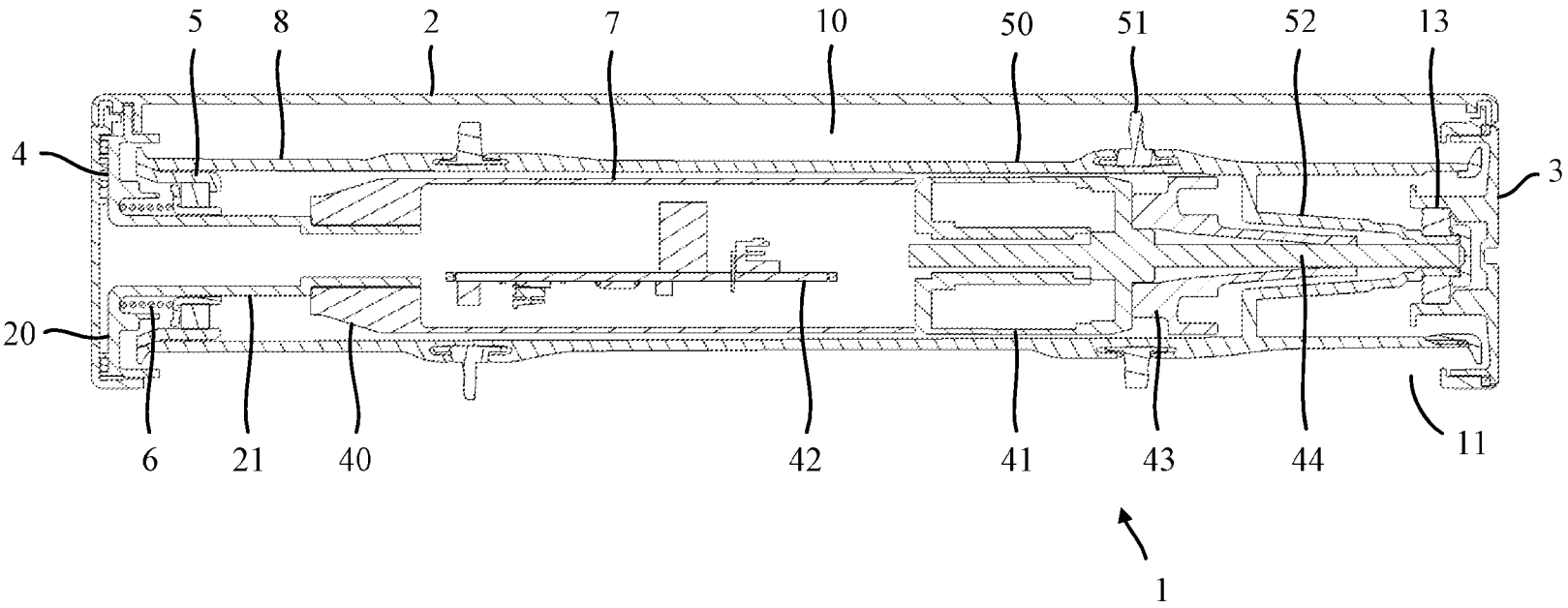
FIG. 4 is a sectional slice through the centre of the cleaner head.
Figure 5:
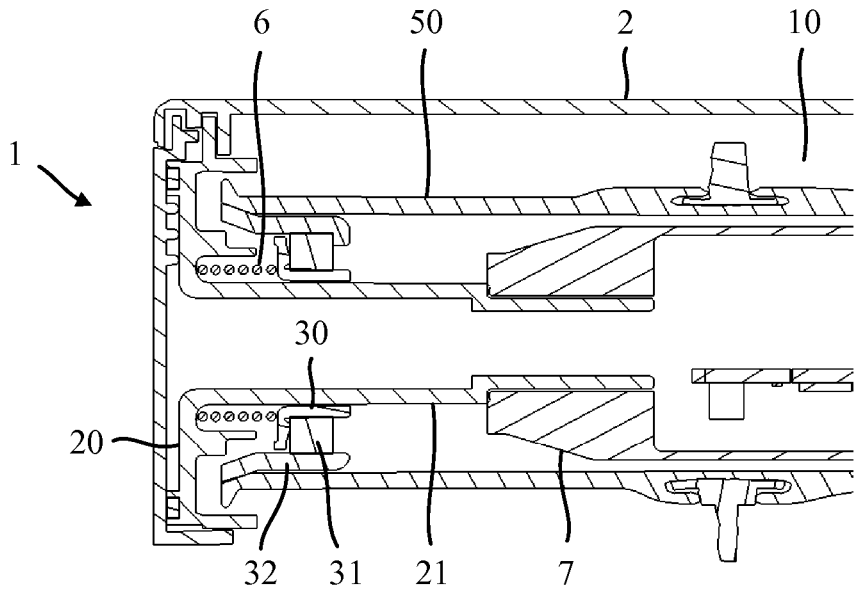
FIG. 5 is a portion of the sectional slice of FIG. 4 in which the agitator is mounted within the main body of the cleaner head and the bearing assembly is in a second position.
Figure 6:
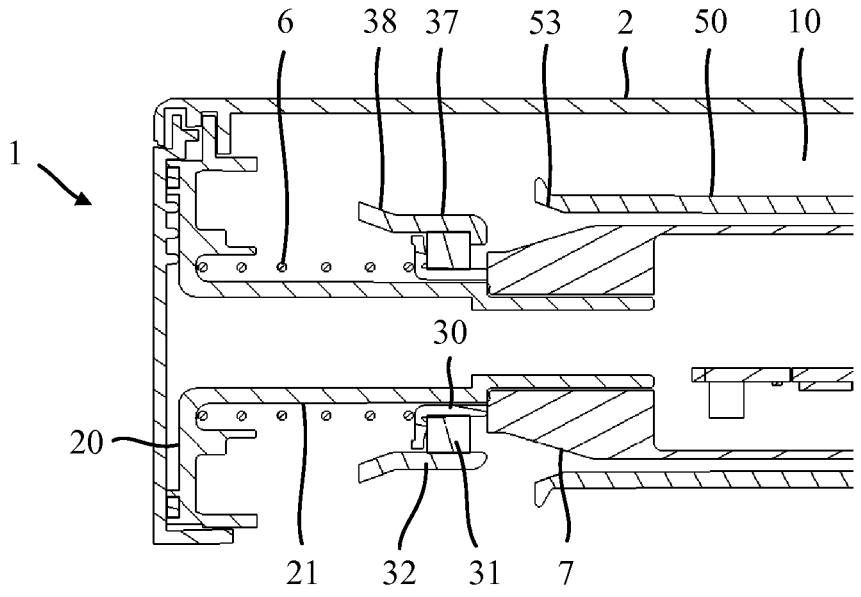
FIG. 6 illustrates the same view as that of FIG. 5 but the agitator is now partly removed from the main body of the cleaner head and the bearing assembly is in a first position.

The cleaner head 1 of FIGS. 1 to 6 comprises a main body 2, a first end cap 3, a second end cap 4, a bearing assembly 5, a biasing member 6, a drive assembly 7 and an agitator 8.

The main body 2 comprises an agitator chamber 10 within which the agitator 8 is rotatable mounted. An opening 11 is provided in the base of the main body 2, through which the agitator 8 is able to agitate a surface. A further opening 12 is provided in a side of the main body 2, through which the agitator 8 is removable from the main body 2.

The two end caps 3,4 are secured to the main body 2 at opposite sides of the agitator chamber 10. The first end cap 3 is secured to the main body 2 so as to close the side opening 12. The end cap 3 is secured by means of a bayonet-style fitting and comprises a number of L-shaped slots that engage with an equal number of projections formed on the main body 2. The second end cap 4 comprises a disc 20, an axle 21 that extends centrally from the disc 20, and a sprocket 22 that surrounds the axle 21. The end cap 4 is secured to the main body 2 such that the axle 21 extends into the agitator chamber 10.

The bearing assembly 5 is slidably mounted on the axle 21. Movement of the bearing assembly 5 along the axle 21 is limited in one direction by the drive assembly 7, which is mounted to the axle 21, and in an opposite direction by the disc 20. Consequently, the bearing assembly 5 is moveable between a first position in which the bearing assembly 5 contacts the drive assembly 7 (see FIG. 6) and a second position in which the bearing assembly 5 contacts the disc 20 (see FIG. 5).

The bearing assembly 5 comprises a carriage 30, a bearing 31 secured to the carriage 30, and a mount 32 secured to the bearing 31. The carriage 30 may be regarded as having a first portion and a second portion. The first portion comprises a collar 33 that surrounds the axle 21. The second portion comprises a brim 34 that extends radially from the collar 33 and a plurality of teeth or pickets 35 that extend axially from the brim 34 in a direction towards the disc 20 of the second end cap 4. The bearing 31 comprises an inner race and an outer race. The inner race is then secured to the carriage 30, and the outer race is secured to the mount 32. The mount 32 comprises a cylindrical section 37 and a conical section 38 that extends outwardly from an end of the cylindrical section 37.

The biasing member 6 comprises a coil spring that surrounds the axle 21. The biasing member 6 is located between the disc 20 of the second end cap 4 and the carriage 30 of the bearing assembly 5. The biasing member 6 thus biases the bearing assembly 5 towards the first position.

The drive assembly 7 is mounted on the axle 21 and comprises a motor mount 40, an electric motor 41, a circuit assembly 42 for controlling the electric motor 41, and a coupling element 43. The motor mount 40 comprises a generally cylindrical body that houses the circuit assembly 42. The motor mount 40 is secured at one end to the axle 21 and at an opposite end to the electric motor 41. The electric motor 41 is secured to the motor mount 40 such that the shaft 44 of the electric motor 41 is co-axial with the axle 21 and thus with the bearing assembly 5. The coupling element 43 is secured to the shaft 44 of the electric motor 41.

The agitator 8 comprises a cylindrical body 50 to which bristles, flicker strips, or other means 51 for agitating a surface are secured. The agitator 8 further comprises a coupling element 52 located inside and formed integrally with the body 50. The agitator 8 is mounted at one end on the bearing assembly 5, and at the opposite end on a bearing 13 seated within the first end cap 3. The agitator 8 is thus rotatably mounted within the agitator chamber 10. The agitator 8 pushes the bearing assembly 5 along the axle 21 against the biasing member 6 towards the second position. The teeth 35 of the carriage 30 then engage with the sprocket 22. The agitator 8 surrounds the drive assembly 7, and the coupling element 43 of the drive assembly 7 engages with the coupling element 52 of the agitator 8 such that the torque generated by the electric motor 41 is transferred to the agitator 8.

During operation, the torque generated by the drive assembly 7 is transferred to the agitator 8, thereby causing the agitator 8 to rotate. The biasing member 6 biases the bearing assembly 5 towards the first position, i.e. in a direction towards the first end cap 3. The agitator 8, which is mounted between the bearing assembly 5 and the first end cap 3, is therefore held relatively tightly within the agitator chamber 10. Consequently, movement of the agitator 8 in an axial direction (i.e. in a direction parallel to the rotational axis of the agitator 8) is significantly reduced. Indeed, axial movement is possible only by overcoming the bias force of the biasing member 6, which is already in a compressed or charged state.

An end of the agitator 8 comprises a conical inner surface 53 which mates with the conical section 38 of the mount 32. Since the biasing member 6 biases the bearing assembly 5 in a direction towards the first end cap 3, the conical section 38 of the mount 32 is pushed into and mates tightly with the conical surface 53 of the agitator 8. This then has two benefits. First, the agitator 8 is held tightly at one end against the mount 32. The opposite end of the agitator is held tightly against the bearing 13 seated within the first end cap 3. Consequently, movement of the agitator 8 in a radial direction (i.e. in a direction normal to the rotational axis of the agitator 8) is prevented. Second, by employing conical surfaces, the concentricity of the agitator 8 relative to the bearing 31 is improved. Consequently, as the agitator 8 rotates, radial loading of the bearing 31 is reduced. In particular, radial loading due to out-of-balance forces are reduced and thus the lifespan of the bearing 31 is prolonged.

The outer diameter of the cylindrical section 37 of the mount 32 is slightly larger than that of the drive assembly 7. Consequently, should the agitator 8 slip off or otherwise find itself unsupported by the conical section 38, the agitator 8 is nevertheless prevented from contacting the drive assembly 7.

The teeth 35 of the carriage 30 engage the sprocket 22 of the second end cap 4 such that rotation of the carriage 30 relative to the axle 21 is prevented. Consequently, as the agitator 8 rotates, the mount 32 and the outer race of the bearing 31 rotate, whilst the carriage 30 and inner race of the bearing 31 remain static. This then ensures that the carriage 30 does not rotate relative to the axle 21, which would otherwise generate significant noise and eventually lead to wear and potential failure of the carriage 30 and/or axle 21.

The agitator 8 is removable from the main body 2 in order that a user may more easily remove hair, fibre, and other debris that have become trapped around the agitator 8. In order to remove the agitator 8, the first end cap 3 is released from the main body 2 by twisting the first end cap 3 relative to the main body 2. The biasing member 6 biases the bearing assembly 5 and thus the agitator 8 in a direction towards the first end cap 3. Consequently, on releasing the first end cap 3, the biasing member 6 pushes the agitator 8 out of the side opening 12. The agitator 8 thus protrudes from the main body 2 allowing a user to grasp the agitator 8 and pull it through the side opening 12.

Once cleaned, the agitator 8 is returned to the main body 2 by inserting the agitator 8 through the side opening 12. As the agitator 8 is pushed through the side opening 12, the agitator 8 slides over the drive assembly 7 like a sleeve. The end of the agitator 8 then contacts the bearing assembly 5. More specifically, the conical inner surface 53 of the agitator 8 mates with the conical section 38 of the mount 32. As the agitator 8 is pushed further into the main body 2, the agitator 8 pushes the bearing assembly 5 against the biasing member 6 towards the second position. The coupling element 52 of the agitator 8 then engages with the coupling element 43 of the drive assembly 7, and the teeth 35 of the carriage 30 engage with sprocket 12 of the second end cap 3. Finally, the first end cap 3, which is carried by the agitator 8 by virtue of the bearing 13, is secured to the main body 2 so as to close the side opening 12.

Figure 7:
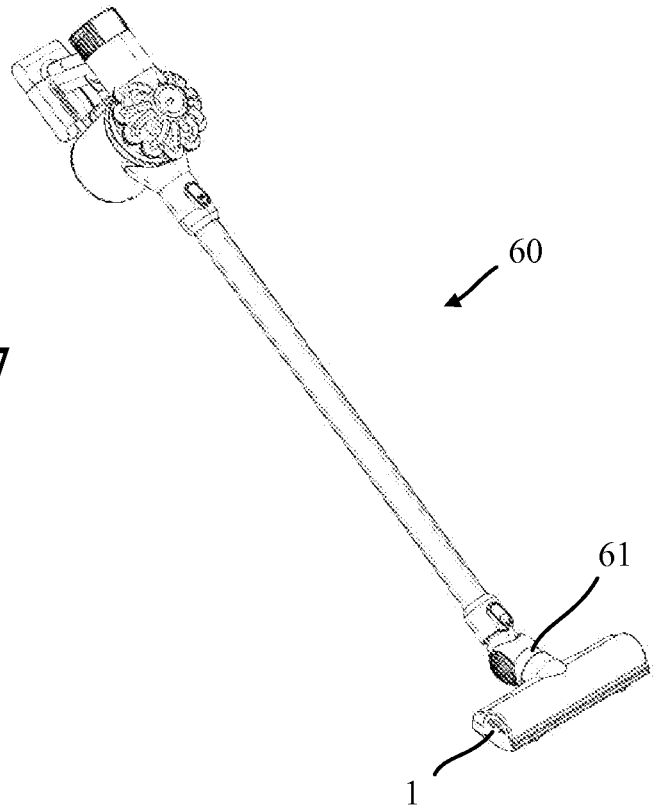
FIG. 7 illustrates a cleaning appliance in accordance with the present invention.
Figure 8:
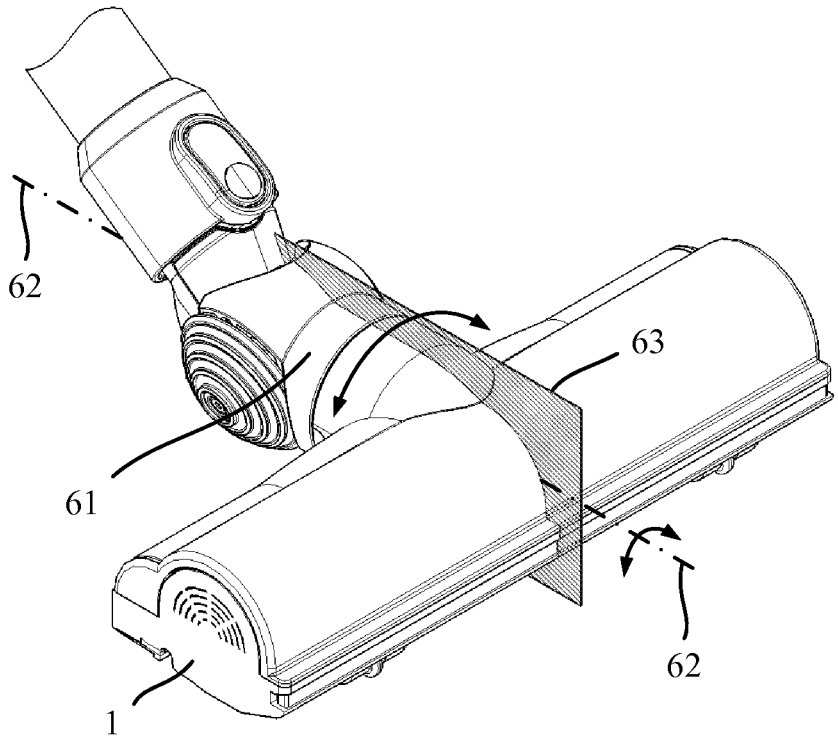
FIG. 8 illustrates part of the cleaning appliance in which the attachment of the cleaner head to a duct is shown, as is the axis of rotation about which the cleaner head rotates relative to the duct.

FIGS. 7 and 8 illustrate a cleaning appliance 60 comprising the cleaner head 1. In this particular example, the cleaning appliance 60 is a stick vacuum cleaner. However, the cleaner head 1 may equally be used with other types of cleaning appliance. The cleaner head 1 is rotatably attached to a duct 61 of the cleaning appliance 60. More particularly, the cleaner head 1 rotates relative to the duct 61 about a rotational axis 62. This rotational axis 62 is then orthogonal to the axis of rotation of the agitator 8. The two axes may be spaced from one another, which is to say that the two axes do not necessary intersect. Nevertheless, the two axes are orthogonal, i.e. the unit vectors are orthogonal.

The drive assembly 7 forms a relatively heavy component of the cleaner head 1 and thus has a large influence on the location of the centre of gravity of the cleaner head 1. The drive assembly 7 is mounted along the axle 21 such that the centre of gravity of the cleaner head 1 lies in a vertical plane 63 containing the rotational axis 62 of the cleaner head 1. This then has the advantage that, when the cleaner head 1 is lifted off the floor (e.g. in order to manoeuvre the cleaner head 1 over or around an object), the cleaner head 1 does not rotate relative to the duct 61. This then makes handling of the cleaner head 1 easier. In contrast, the centre of gravity of most conventional cleaner heads is offset relative to the axis of rotation. Consequently, when the cleaner head is lifted off the floor, the cleaner head rotates to one side, thus making handling more difficult.

A weight-balanced cleaner head 1 is made possible by having a motor mount 40 that spans the vertical plane 63 containing the rotational axis 62 of the cleaner head 1. Consequently, the electric motor 41, which represents a relatively heavy component of the drive assembly 7 and thus of the cleaner head 1, is mounted to the main body 2 on one side of the vertical plane 63 but is then physically located on the opposite side of the vertical plane 63. It is not at all obvious to locate the electric motor 41 in this manner, particular when the agitator 8 is removable, since the weight of the electric motor 41 generates a relatively large moment of force that acts on the axle 21. Moreover, if there is any radial play in the agitator 8, the weight of the electric motor 41 acting on the agitator 8 will cause the rotational axis of the agitator 8 to precess, thereby generating significant out-of balance forces.

The centre of gravity of the cleaner head 1 need not lie directly on the rotational axis 62 of the cleaner head 1. Rotation of the cleaner head 1 relative to the duct 61 will also be prevented by having a centre of gravity that is located directly above or below the rotational axis 62. It is for this reason that reference is made to a vertical plane 63 containing the rotational axis 62.

In the embodiment described above, the agitator 8 is removable from the main body 2. This then has the advantage that debris trapped around the agitator 8 may be more easily removed. Nevertheless, it is not essential that the agitator 8 is removable from the main body 2, and trapped debris may be removed by accessing the agitator 8 via the opening 11 in the base of the main body 2.

The drive assembly 7 comprises an electric motor 41, which generates the torque necessary to drive the agitator 8. Conceivably, the drive assembly 7 might comprise alternative means for generating the necessary torque. For example, where the cleaner head 1 is intended to form part of a vacuum cleaner, the drive assembly 7 may comprise an air turbine. The suction generated by the vacuum cleaner may then cause air to be drawn in through an opening in a side of the main body 2, through the centre of the axle 21, through the drive assembly 7 to thereby power the air turbine, and then out through an end of the agitator 8 and into the agitator chamber 10.

In the embodiment described above, the drive assembly 7 is located wholly within the agitator 8. This then has the advantage of providing a relatively compact cleaner head 1. Nevertheless, the drive assembly 7, or part thereof, may be located outside the agitator 8. For example, the electric motor 41 and the circuit assembly 42 may be located elsewhere in the main body 2, and torque may be transferred from the electric motor 41 to the agitator 8 via a transmission arrangement. Moreover, depending on the type of cleaning appliance, the drive assembly 7 could conceivably be located within the body of the cleaning appliance.

The mount 32 has been described as having a cylindrical section 37 and a conical section 38. The conical section 38 then mates with a conical surface 53 of the agitator 8, and the cylindrical section 37 provides a safeguard for supporting the agitator 8 should the agitator 8 slip from the conical section 38. In should nevertheless be appreciated that the mount 32 may have any shape capable of supporting the agitator 8. That being said, there are advantages in providing the mount 32 with a ramped surface that mates with a corresponding ramped surface in the agitator 8. In particular, movement of the agitator 8 in a radial direction may be prevented or significantly reduced. Additionally, relatively good concentricity may be achieved between the agitator 8 and the bearing 31. Consequently, radial loading of the bearing 31 by the agitator 8 is reduced and thus the lifespan of the bearing 31 is prolonged.

Remaining with the bearing assembly 7, it is not necessary that the carriage 30 of the bearing assembly 7 has teeth 35 or that the first end cap 3 has a sprocket 22. Indeed, it is not essential that the bearing assembly 7 comprises a carriage 30 at all. For example, the carriage 30 may be omitted and the inner race of the bearing 31 may contact and slide up and down the axle 21. The disadvantage of this arrangement, however, is that the inner race of the bearing 31 may rotate relative to the axle 21 during use. As a further alternative, the teeth 35 and the sprocket 22 may be omitted and rotation of the carriage 30 relative to the axle 21 may be prevented by other means. For example, the axle 21 may have a non-circular cross-section or the carriage 30 may have projections that engage with grooves in the axle 21. However, since the bearing 31 is circular, the use of a non-circular axle 21 is likely to increase the outer diameter of the bearing assembly 7. Furthermore, the inside of the axle 21 may be used to carry an airflow to the drive assembly 7, e.g. in order to cool or drive components of the drive assembly 7. Employing an axle 21 having a non-circular cross-section or grooves is likely to reduce the cross-sectional area inside the axle and thus impede the flow of air to the drive assembly 7.

The invention claimed is:

1. A cleaning appliance comprising a cleaner head rotatably attached to a duct, the cleaner head comprising:

a main body having an agitator chamber and an opening;

an end cap attachable to the main body to close the opening, the end cap forming an outer surface of the cleaner head when the end cap is attached to the main body;

an axle that extends into the agitator chamber;

a drive assembly comprising a motor, the drive assembly being mounted on the axle; and an agitator mounted within the agitator chamber so as to surround the drive assembly, wherein the agitator is mounted at a first end on a bearing or bushing seated within the end cap, and the agitator is removable from the main body and the drive assembly through the opening, wherein the motor of the drive assembly comprises a shaft that is coupled to the agitator such that torque generated by the motor is transmitted to the agitator via the shaft, the cleaner head rotates relative to the duct about a rotational axis, and the drive assembly is mounted along the axle such that the centre of gravity of the cleaner head is located on a vertical plane containing the rotational axis.

2. The cleaning appliance of claim 1, wherein the drive assembly comprises a motor mount, the motor mount is attached at one end to the axle and at an opposite end to the motor, and the motor mount extends through the vertical plane.

3. The cleaning appliance of claim 1, wherein the agitator rotates about a further rotational axis that is orthogonal to the rotational axis.

4. The cleaning appliance of claim 1, wherein the cleaner head comprises a bearing assembly mounted on the axle, and the agitator is mounted at a second end on the bearing assembly.

5. A cleaning appliance comprising a cleaner head rotatably attached to a duct, the cleaner head comprising:

a main body having an agitator chamber and an opening;

an end cap attachable to the main body to close the opening, the end cap forming an outer surface of the cleaner head when the end cap is attached to the main body;

an axle that extends into the agitator chamber;

a drive assembly mounted on the axle; and an agitator mounted within the agitator chamber so as to surround the drive assembly, wherein the agitator is mounted at a first end on a bearing or bushing seated within the end cap, and the agitator is removable from the main body and the drive assembly through the opening, wherein the drive assembly is coupled to the agitator such that torque generated by the drive assembly is transmitted to the agitator, the cleaner head rotates relative to the duct about a rotational axis, the drive assembly comprises a motor mount and an electric motor, the motor mount is attached at one end to the axle and at an opposite end to the electric motor, the motor mount extends through a vertical plane containing the rotational axis, and the agitator is rotatable relative to the motor mount.

6. The cleaning appliance of claim 5, wherein the agitator is rotatable relative to the motor mount about a further rotational axis that is orthogonal to the rotational axis.

7. The cleaning appliance of claim 5, wherein the cleaner head comprises a bearing assembly mounted on the axle, and the agitator is mounted at a second end on the bearing assembly.

8. A cleaning appliance comprising a cleaner head rotatably attached to a duct, the cleaner head comprising:

a main body having an agitator chamber and an opening;

an end cap attachable to the main body to close the opening, the end cap forming an outer surface of the cleaner head when the end cap is attached to the main body;

an agitator rotatably mounted within the agitator chamber; and a drive assembly comprising a motor that comprises a shaft, the shaft being coupled to the agitator such that torque generated by the motor is transmitted to the agitator via the shaft, wherein the cleaner head rotates relative to the duct about a rotational axis, and the drive assembly is located within the agitator such that the centre of gravity of the cleaner head is located on a vertical plane containing the rotational axis, and wherein the agitator is mounted at one end on a bearing or bushing seated within the end cap, and the agitator is removable from the main body and the drive assembly through the opening.

9. The cleaning appliance of claim 8, wherein the agitator rotates about a further rotational axis that is orthogonal to the rotational axis.

10. The cleaning appliance of claim 8, wherein the drive assembly comprises a motor mount, the motor mount is attached at one end to the main body and at an opposite end to the motor, and the motor mount extends through the vertical plane.

11. The cleaning appliance of claim 10, wherein the drive assembly comprises a circuit assembly for controlling the motor, and the circuit assembly is housed within the motor mount.

* * * * *